US005519422A

United States Patent [19]

Thoman et al.

[11] Patent Number: 5,519,422

[45] Date of Patent: May 21, 1996

[54] METHOD AND DEVICE FOR PREVENTING UNINTENDED USE OF PRINT CARTRIDGES

[75] Inventors: Jeffrey A. Thoman; Brian D. Gragg, both of San Diego, Calif.

[73] Assignee: Hewlett-Packard Company, Palo Alto, Calif.

[21] Appl. No.: 56,961

[22] Filed: May 3, 1993

[51] Int. Cl.[6] ..... B41S 2/175

[52] U.S. Cl. ..... 347/49; 347/87

[58] Field of Search ..... 346/140 R; 347/86, 347/87, 49

[56] References Cited

U.S. PATENT DOCUMENTS

| | | | |
|---|---|---|---|
| 4,712,172 | 12/1987 | Kiyohara et al. | 346/1.1 |
| 4,774,529 | 9/1988 | Paranjpe et al. | 347/43 |
| 4,907,019 | 3/1990 | Stephens | 347/86 |

FOREIGN PATENT DOCUMENTS

| | | | |
|---|---|---|---|
| 0412459A3 | 3/1990 | European Pat. Off. . | |
| 0412459A2 | 3/1990 | European Pat. Off. . | |
| 0452585A2 | 7/1990 | European Pat. Off. . | |
| 60-192637 | 1/1985 | Japan | B41S 3/04 |
| 89/08028 | 9/1989 | WIPO . | |

*Primary Examiner*—Joseph W. Hartary
*Assistant Examiner*—Craig A. Hallacher

[57] ABSTRACT

In a printer carriage adapted for holding multiple pen cartridges in separate compartments, each carriage compartment includes one or more key-coded barriers at an entrance to the compartment to provide a first level carriage lockout scheme against non-matching cartridge tabs. A second level carriage lockout is provided to differentiate between different families of print cartridges which successfully pass through the first level lockout, which second level is based on predetermined barrier floor configurations in the bottom of each carriage compartment which block non-matching wings on particular print cartridge families.

12 Claims, 9 Drawing Sheets

FAMILY I

FAMILY II

FAMILY III

METHOD AND DEVICE FOR PREVENTING UNINTENDED USE OF PRINT CARTRIDGES

RELATED APPLICATIONS

This application relates to co-pending application Ser. No. 08/057,241 of inventors Swanson et al. entitled SIDE BIASED DATUM SCHEME FOR INKJET CARTRIDGE AND CARRIAGE filed Apr. 30, 1993, which application is assigned to the assignee of the present application and which is incorporated herein by reference and which is incorporated by reference.

TECHNICAL FIELD

This invention relates generally to print cartridges which are removably mounted in a printer carriage, and more specifically to schemes for preventing a user from mounting the wrong print cartridge in a printer carriage. The terms "pen" and "print cartridge" are used synonymously and interchangeably herein.

BACKGROUND OF THE INVENTION

In the past, the typical way of indicating to the user the type and color of a print cartridge to be used in printers such as inkjet printers having removable print cartridges was to color code this information on the outside of the print cartridge housing. This approach had the disadvantage of providing no positive feedback to the user, and furthermore it would not prevent improper use for those print cartridges and printer carriages which were otherwise configured for proper mating of the print cartridge into the printer carriage. This use of print cartridges in printer carriages for which they were not intended can result in undesirable print quality and possible damage to both the print cartridge and the printer in which it is used.

BRIEF SUMMARY OF THE INVENTION

The general purpose and principal object of the present invention is to provide a new and improved method for preventing insertion of a print cartridge into a printer carriage compartment for which it was not intended, and further having mechanical and visual feedback to the end user that absolutely prevents the wrong inkjet pen or print cartridge from being inserted into the wrong printer carriage or wrong carriage compartment.

Another object of this invention is to provide a new and improved method of the type described wherein all configuration features on the print cartridge used for lockout purposes may be removed to produce a universal pen for all inkjet printers.

One implementation of this invention provides a print carriage adapted for holding multiple pen cartridges, wherein each carriage compartment includes one or more key-coded barriers at an entrance to the compartment as well as one or more key-coded barriers at the base of the printhead stall in the compartment, both type of barriers being sized and shaped to receive corresponding configuration features of the appropriate pen cartridge when the pen cartridge is manually inserted into one of the carriage compartments.

To accomplish the above purpose and objects, the present method includes the steps of providing first, second, and if desirable additional pen families with a first level lockout based on configurable tabs located at certain positions of the print cartridges to designate a print cartridge characteristic such as ink type, color, energy requirements, electrical interconnect, resolution, printhead, or the like, with the first pen family having a different tab configuration (size, shape, number, position, etc.) associated with the second pen family. Thus, for example, if a first pen family is identified by having a fewer number of tabs per print cartridge as compared to a second pen family, the second pen family is always locked out of carriage compartments key-coded for receiving the first pen family at a first lockout level, but all of the print cartridges in the first pen family may not be locked out of all second family compartments at the first lockout level. This first level lockout principle can similarly be applied to additional pen families.

The present method further includes providing the first pen family with a second level of lockout on the print cartridge sufficiently different in configuration from that of the second pen family so that none of the cartridges in the first pen family will be accepted by second family compartments key-coded at the second lockout level. This second level lockout principle can also similarly be applied to additional pen families.

In a preferred embodiment of the invention, the second level of lockout for the first pen family is provided by configuring a barrier floor in the bottom of a carriage compartment to extend different predetermined distances for each pen family. For example, by constructing a half floor in the second family compartments and then mating it for abutment with a pre-positioned wing on the first family print cartridges, the half floor will prevent complete insertion of all first family pens and thereby provide a second level of lockout in second famly carriage compartments.

The above brief summary of the invention, together with its attendant objects and advantages, will become better understood with reference to the following description of the accompanying drawings.

DETAILED DESCRIPTION OF PREFERRED EMBODIMENTS

Figure 1A:
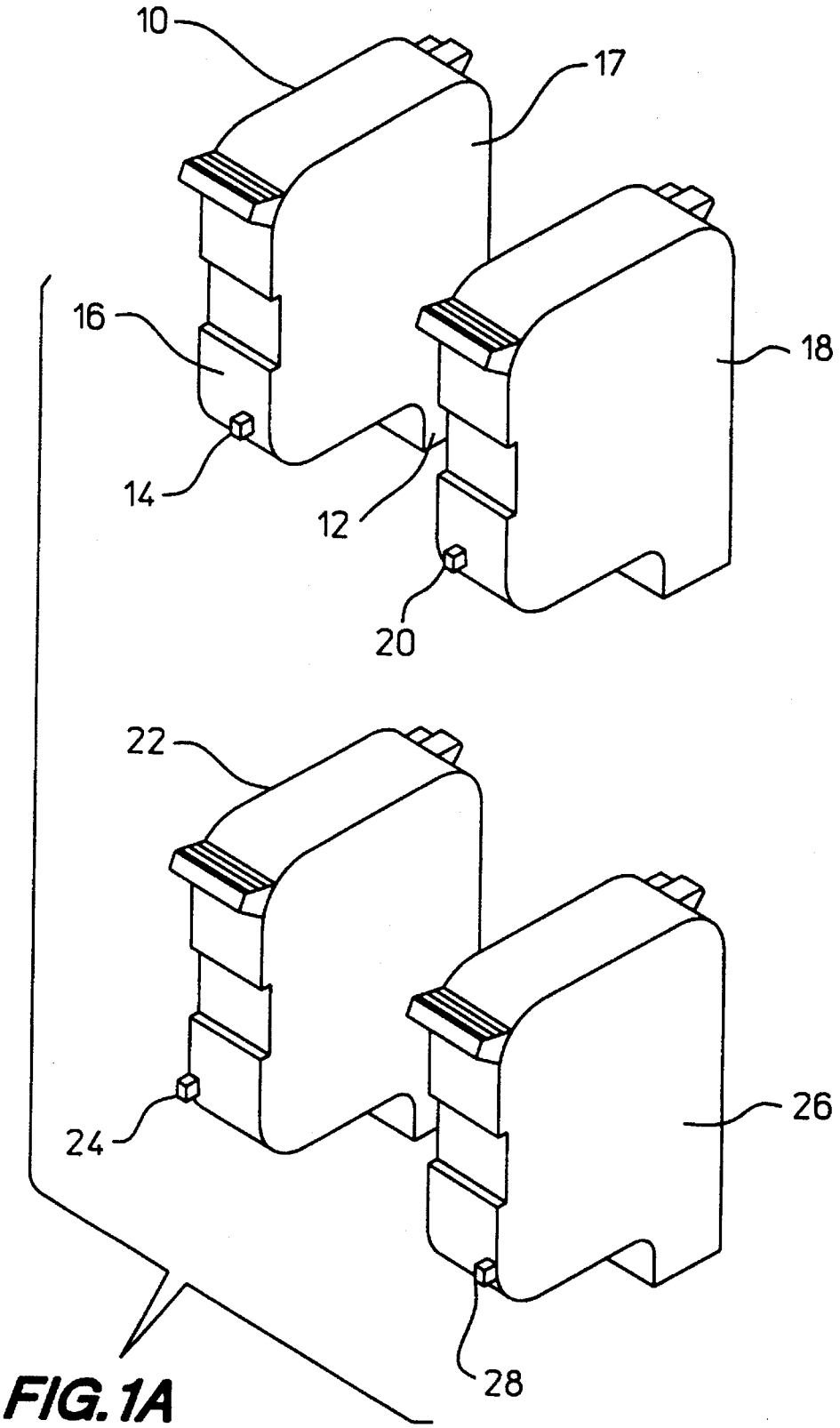
FIG. 1A is a perspective view of four print cartridges for a first pen family showing four exemplary single tab configurations for a first level lockout scheme of the present invention.

Referring now to FIG. 1A, there is shown a first family of pens, with each pen including a main print cartridge housing 10 having a printhead section 12 and further including a single tab 14 positioned as shown at a third from left position on a lower front shoulder 16 of a first pen 17. A second pen 18 in the first family has a tab 20 located in a second position (from left to right), whereas a third pen 22 in the first family has a tab 24 located in the first position. Finally, pen 26 has its tab 28 located in a fourth and last position over on the right hand side of the pen.

Of course, the numbers of tabs is exemplary only, and may be varied in accordance with the number and types of pen that are being used.

Figure 1B:
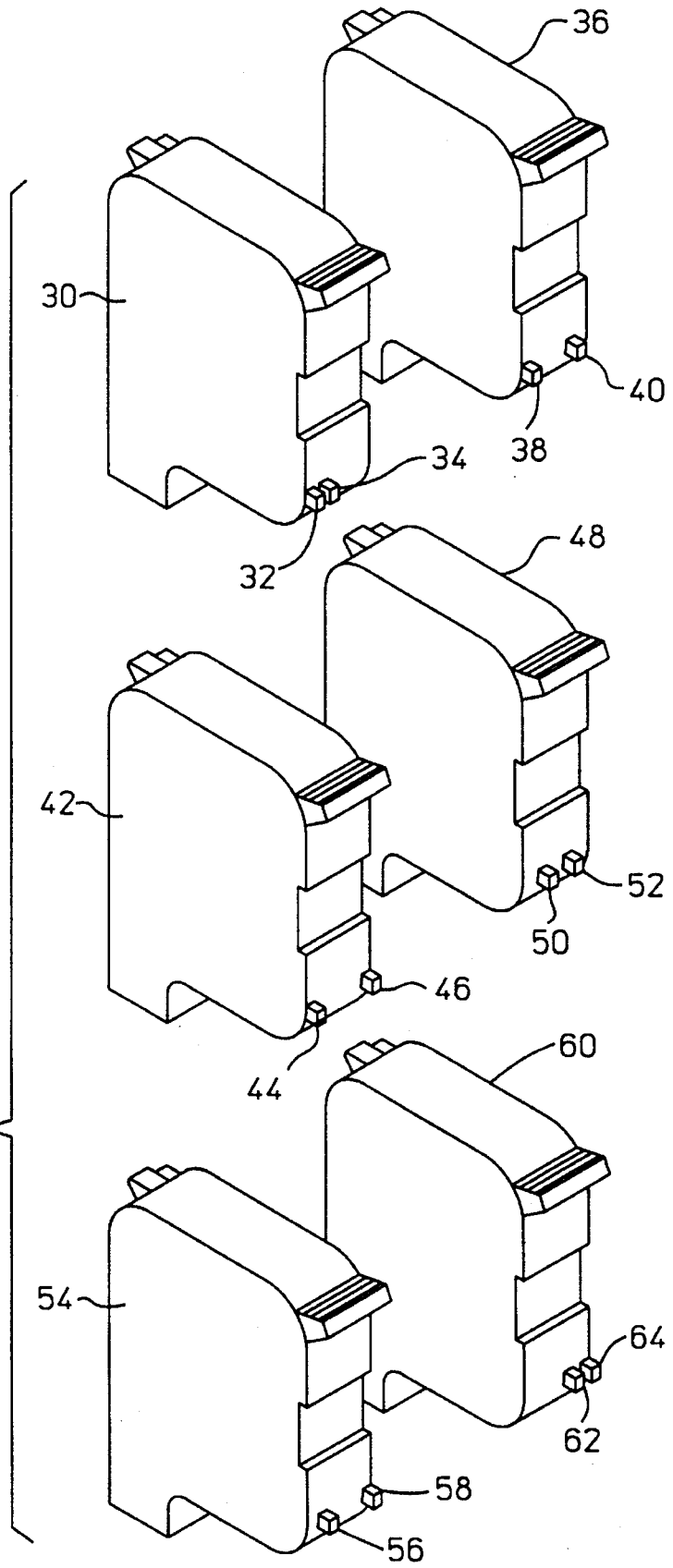
FIG. 1B is a perspective view of six print cartridges for a second pen family showing six exemplary double tab configurations for a first level lockout.

Referring now to FIG. 1B, a first pen in a second family has two tabs 32, 34 positioned on the left hand side of the print cartridge housing, whereas a second pen 36 shows tabs 38, 40 located at first and third locations reading from left to right. A third pen 42 in the second family has tabs 44, 46 located at first and fourth positions, whereas a fourth pen 48 has its tabs 50, 52 located at second and third positions, A fifth pen 54 has tabs 56, 58 located at second and fourth positions, and finally, a sixth pen 60 has tabsl 62, 64 located at third and fourth positions. Thus, each of the ten different tab positions represent ten different pen types for the first and second pen families.

Figure 2A:
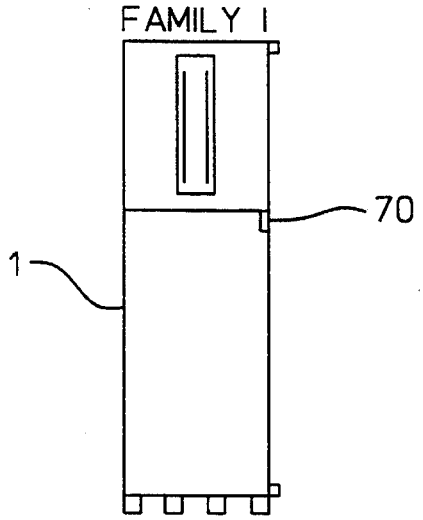
FIG. 2A is an end view of all pen cartridges of the first pen family prior to being separately tab configured per FIGS. 1A and 3A, showing the first family wing configuration for a second level lockout.
Figure 2B:
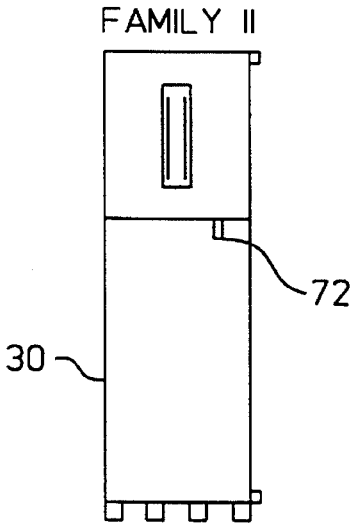
FIG. 2B is an end view of all pen cartridges of the second pen family prior to being separately tab configured per FIGS. 1B and 3B showing the second family wing configuration for a second level lockout.
Figure 2C:
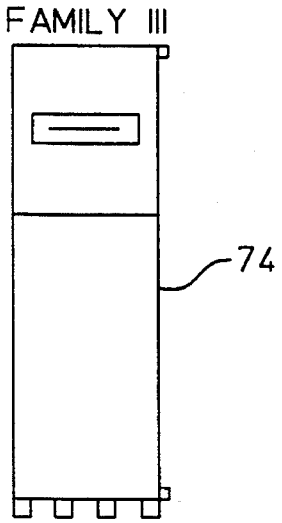
FIG. 2C is an end view of all pen cartridges of the third pen family prior to being separately tab configured per FIG. 3C showing the third family wing configuration (i.e., no wing) for a second level lockout.
Figure 3A:
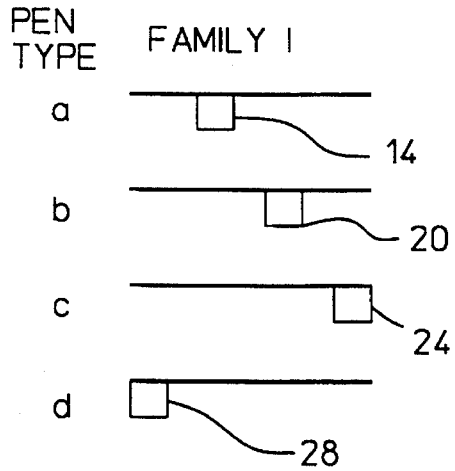
FIG. 3A is an abbreviated schematic diagram showing the tab positions for the first family print cartridges of FIG. 1A.
Figure 3B:
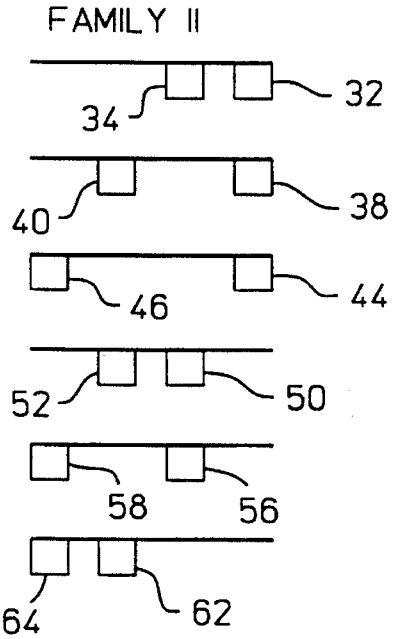
FIG. 3B is an abbreviated schematic diagram showing the tab positions for the second family print cartridges of FIG. 1B.
Figure 3C:
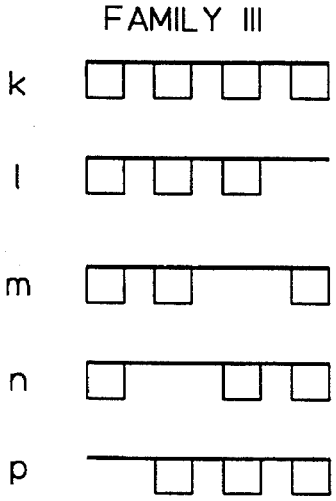
FIG. 3C is an abbreviated schematic diagram showing the tab positions for the third family print cartridges of FIG. 2C.

Referring now to FIG. 2A–2C, these views correspond to the bottom surfaces of the pens which face the media to be printed and show different second level lockout wings for all pens in a particular family. FIGS. 3A–3C schematically show different first level lockout tabs for individual pens. It is seen that the first pen family is based on single tabs in four individual pen options, whereas the second family is based on double tabs in six individual pen options. It is also seen that the second family with double tabs is always locked out of the first family single tab carriage compartments at a first level, but there are certain situations where a first family single tab pen will not be locked out of the second family double tab carriage compartments at this first level. For example, tab 14 of pen "a" in first family will match up with second tab positions 40, 52, and 62 of pens f, h and j in second pen family and will thus fit into the second family carriage compartments but for a second level of pen lockout to be described. Tab 20 of pen b in the first pen family matches up with tabs 34, 50, and 56 in the pens f, h, and i of the second family and thus will fit into the second family carriage compartments but for a second level of pen lockout to be described, and so on.

Figure 4A:
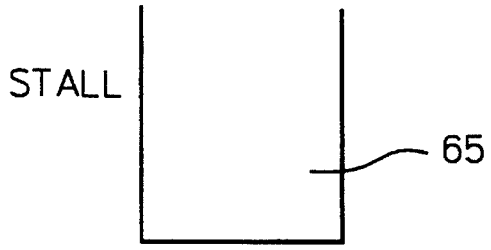
FIG. 4A schematically shows the carriage stall layout for a second level lockout scheme designed to receive only the first famliy pens.
Figure 4B:
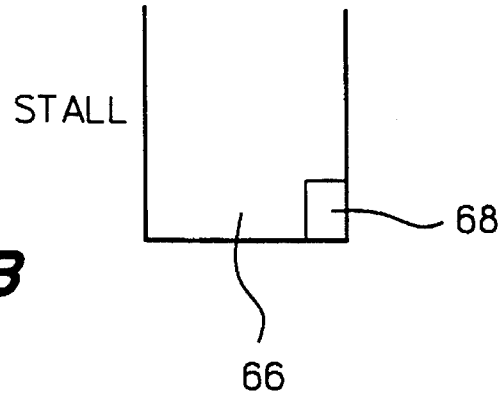
FIG. 4B schematically shows the carriage stall layout for a second level lockout scheme designed to receive only the second family pens.
Figure 4C:
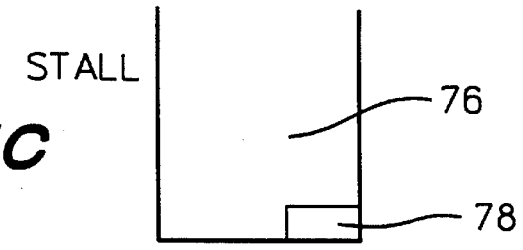
FIG. 4C schematically shows the carriage stall layout for a second level lockout scheme designed to receive only the third family pens.

Therefore, in order to provide a second level of lockout for the first family pens, the carriage stalls for receiving the print/snout of the pen cartridges of second and third pen families are respectively provided with barriers such as a half floor 68 as shown in FIG. 4B and a full floor 78 as shown in FIG. 4C. In addition, all first family single tab pens 17, 18, 22, 26 are provided with an edge wing 70 so that the edge wing 70 will come into contact with the half floor 68 barrier and the full floor 78 barrier, thereby locking out at the second level all first family pens from second and third family carriage stalls. Since first family carriage stall 65 has no barrier floors, all first family pens will fit into first family stall 65 at the second level.

In order to provide a second level of lockout for the second family pens, the carriage stalls for receiving the print/snout of the pen cartridges of third pen families are provided with barriers such as full floor 78 as shown in FIG. 4C. In addition, all second family double tab pens 30, 36, 42, 48, 54, 60 are provided with an inset wing 72 so that the inset wing 72 will come into contact with the full floor 78 barrier, thereby locking out at the second level all second family pens from the third family carriage stalls. Since the second family carriage stall 66 has only a half floor 68 barrier, all second family pens will fit into second family stall 66 at the second level because inset wing 72 will bypass half floor 68 barrier.

Finally, the third family of pens needs no second level lockout since all third family pens have triple or quadruple tabs (see FIG. 3C) and therefore are necessarily locked out at the first level from first and second family carriage compartments. So therefore all third family of pens k, l, m, n and p as exemplified in FIG. 2C as 74 have a wing configuration which is "no wing" so that all third family pens will fit into third family stall 76 without any blocking by full floor barrier 78.

It will therefore be appreciated to those skilled in the art that any first family single tab pens that pass through the first level lockout scheme for second and third family pens are locked out from second and third family stalls at the second level. Similarly, any second family double tab pens that pass through the first level lockout scheme for third family pens are locked out from third family stalls at the second level.

Finally, all print cartridges are preferably molded with configurable tabs and configurable wings, such that each cartridge can be key-encoded according to any predetermined lockout scheme. In other words, undesirable wings or tabs are easily broken off, thereby leaving only the tabs associated with a particular pen type, and thereby leaving only the wings associated with a particular pen family. Nevertheless, there is some family grouping that is inherent in the first level lockout scheme in order to achieve the unique aspects of this invention: all first family pens have single tab configurations; all second family pens have double tab configurations; and all third family pens have triple or more tab configurations.

Figure 5:
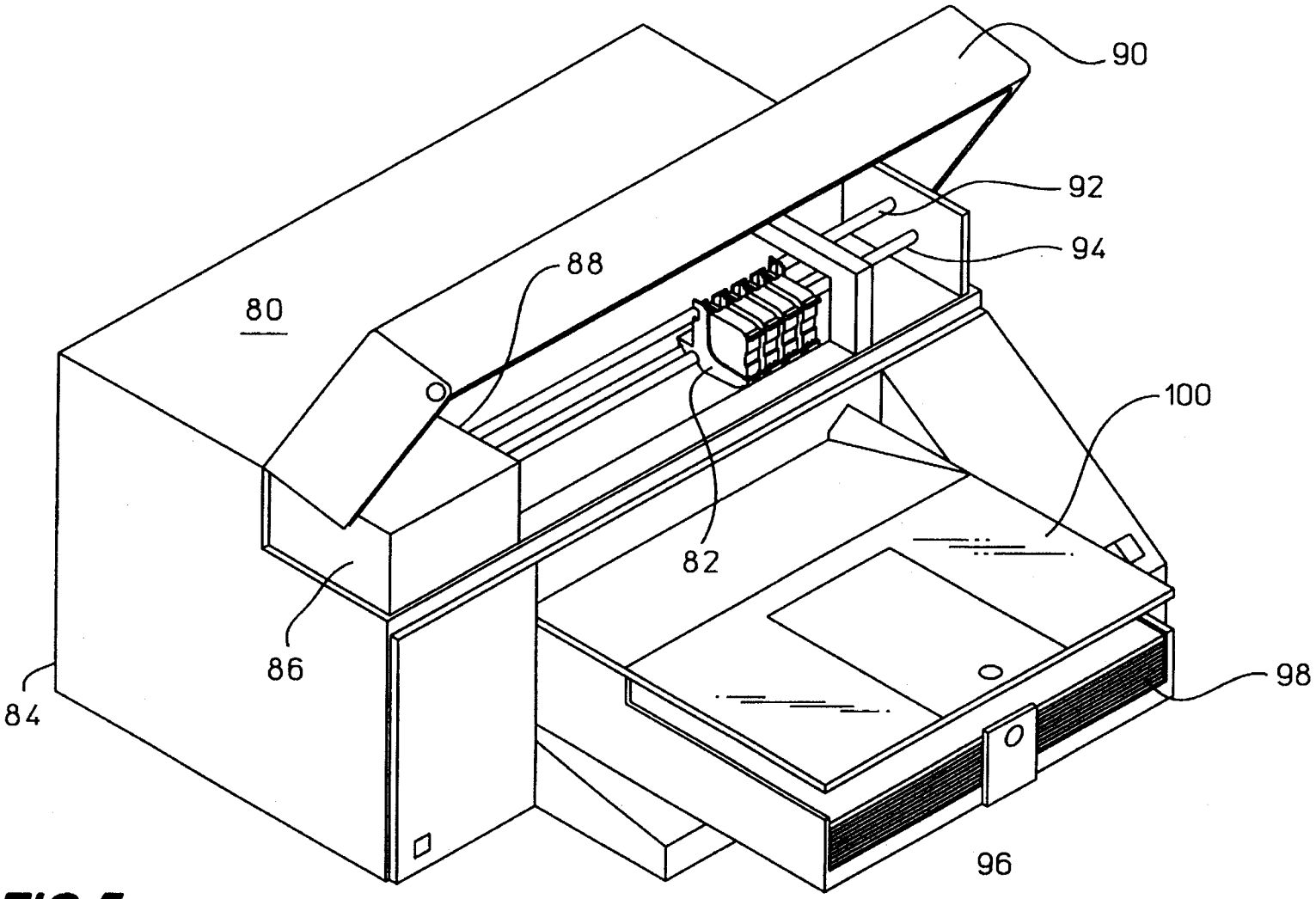
FIG. 5 is a perspective view showing a preferred printer environment for the invention with a four cartridge pen carriage.

Referring now to FIG. 5, there is shown a desk top printer 80 having a carriage which has been specifically designed to accept the ink pens which have been described above. These ink jet pens are received in a four compartment print carriage 82 which is shown in an enlarged perspective view in FIG. 6. The printer 80 comprises a housing 84 having an upper section 86 in which a front opening 88 gives easy access for insertion and removal of cartridges in carriage 82 into and out of the printer. Section 86 of the printer is provided with a rotatable protective cover 90 for protecting the carriage when the printer is in use, but provides easy front loading accessibility to the carriage when pen replacement is desired. The carriage is mounted on a rail or slide bar 94 with an encoder strip 92 used to indicate the carriage position as it scans across the media. The printer also includes an input tray 96 for receiving a media stack 98 and an output tray for printed media exiting the printer.

Figure 6:
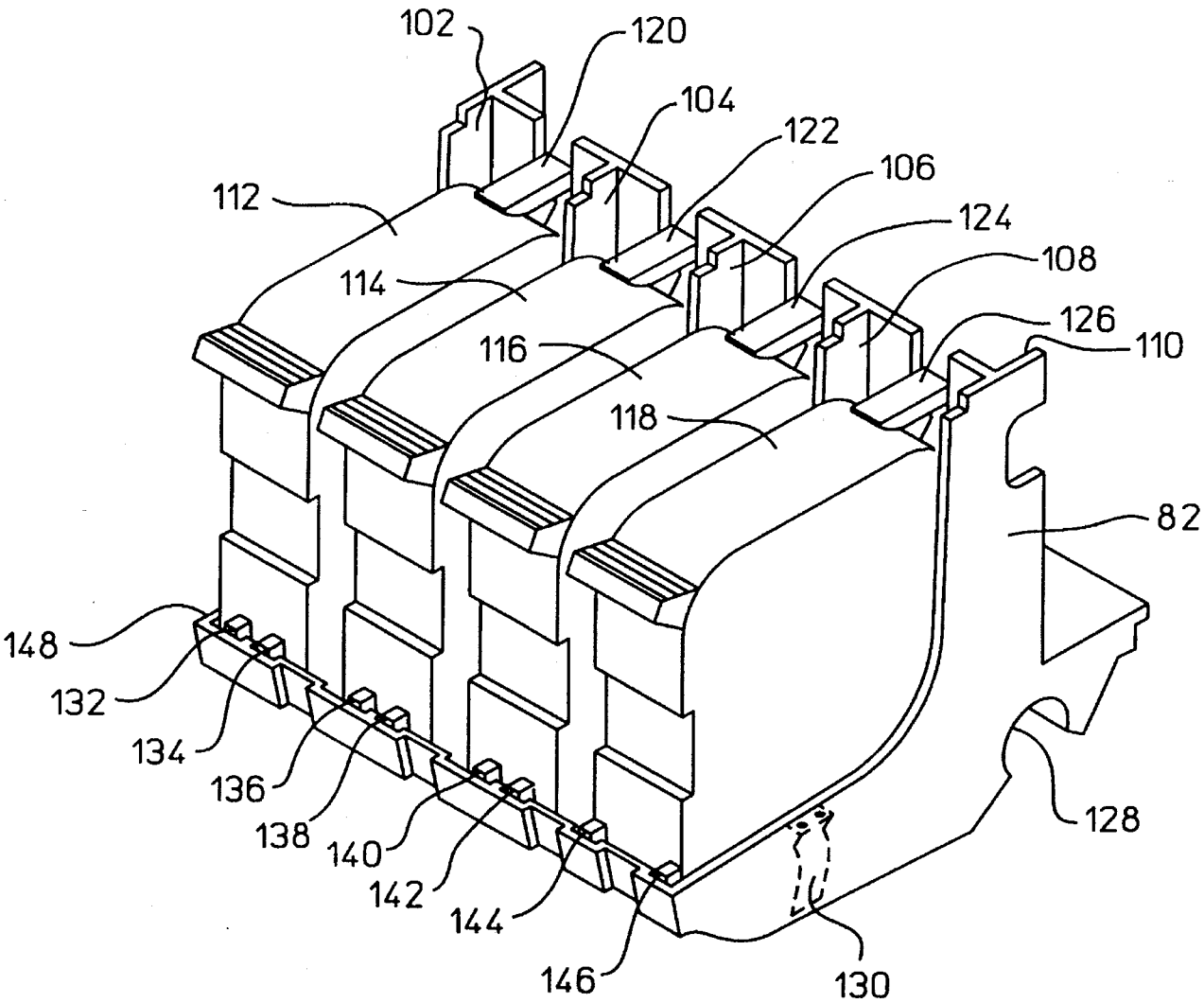
FIG. 6 is an enlarged perspective view showing three different color ink pens with the same identical first level lockout tabs mounted in the pen carriage of FIG. 5, and one black ink pen with different first level lockout tabs also mounted in the pen carriage.

Referring now to FIG. 6, the carriage includes four compartments partitioned by walls 102, 104, 106, 108, and 110. The similar type color pens of cyan, yellow and magenta (112, 114, and 116) are mounted in the first three compartments and the different type black pen 118 is mounted in the fourth foreground compartment. Each of the four pens is secured by top bias spring members 120, 122, 124, 126, respectively. As previously indicated, the various tabs 132, 134, 136, 138, 140, 142, 144, 146 on the rear shoulder surfaces of each of the pens will be received in the corresponding slots in a unitary rear section 148 of the carriage.

Figure 7:
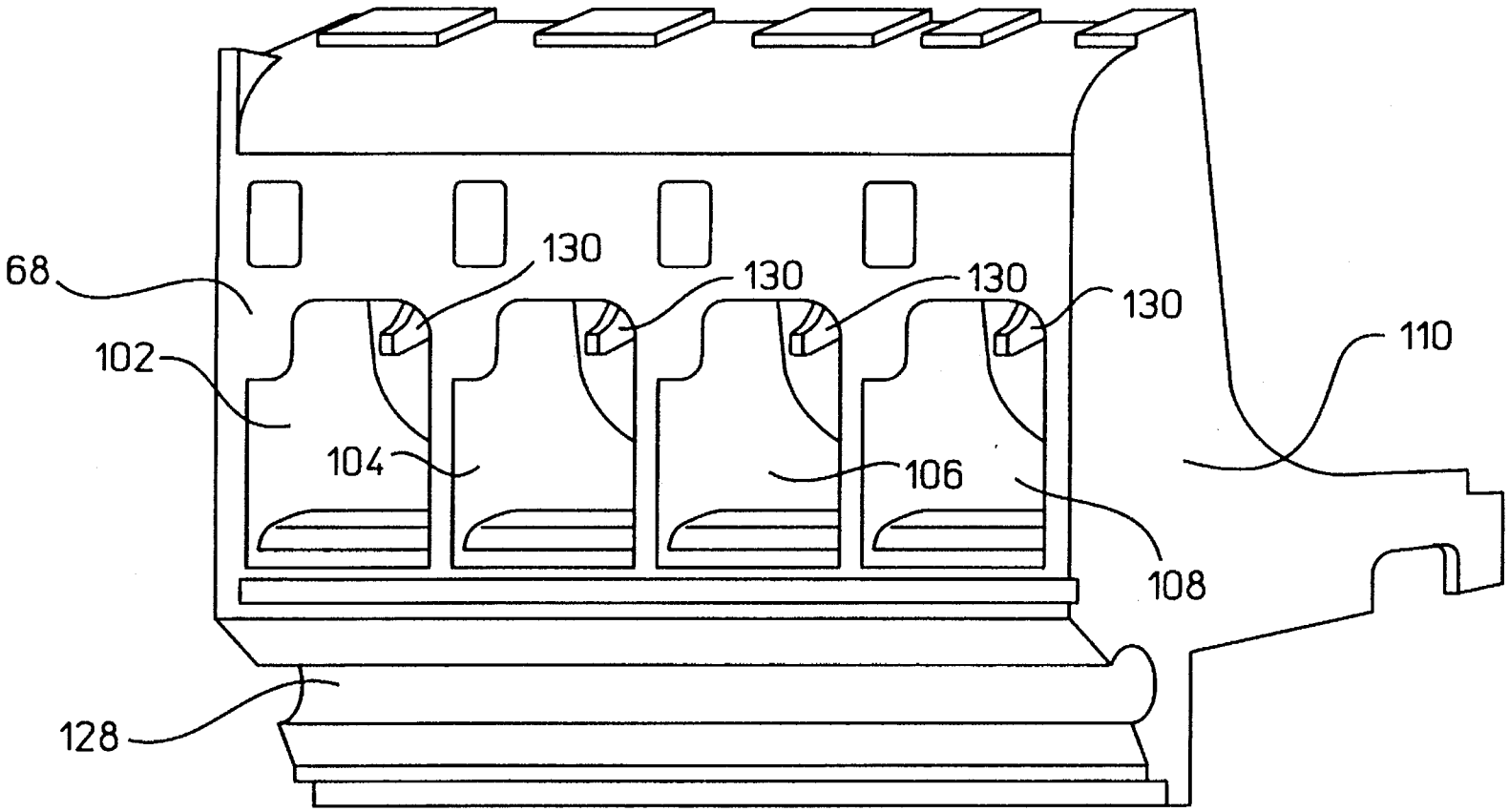
FIG. 7 is a bottom view of the carriage of FIG. 6 with the pen cartridges removed, showing an implementation of the second level lockout scheme of FIG. 4B.

FIG. 7 shows the underside of the carriage with the printhead/snout stalls and half floor second level lockout barriers, as previously described.

Figure 8A:
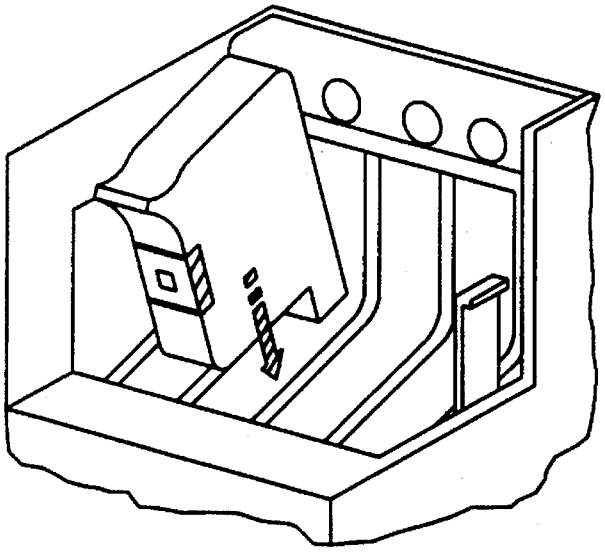
FIG. 8A is a schematic illustration of the initial print cartridge insertion into a carriage which can be prevented by a first level lockout scheme of the present invention.
Figure 8B:
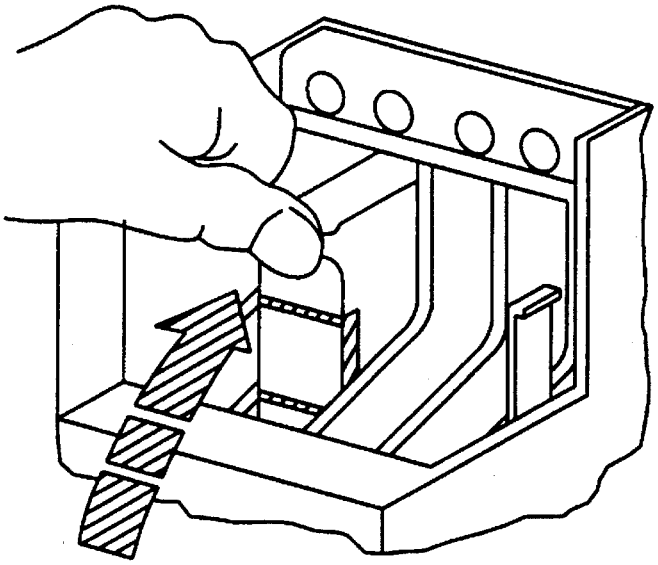
FIG. 8B is a schematic illustration of the final print cartridge insertion into a carriage which can be prevented by a second level lockout scheme of the present invention.

FIG. 8A shows initial insertion of the cartridge that is prevented by the first level lockout, and FIG. 8B shows the final insertion of the cartridge that is prevented by the second level lockout.

It is to be noted that this pen and carriage mechanical lockout design provides the user with immediate tactile and visual feedback. The pen, upon attempted insertion in an incorrect carriage chamber, will be blocked well above the position that a correctly coded pen would stop. This mechanical stop gives the user immediate tactile feedback as to their incorrect pen insertion. Further, since the lockout tabs are located on a surface visible to the user during pen insertion, the user will receive visual feedback if inserting an incorrectly coded pen into a carriage coded for another pen.

By providing a positivbe mechanical block to incorrect pen types, full insertion of any incorrect pens is prevented. This sytem design prevents the full insertion of any incorrect pen type that could result in failures of the pen and pringer system including the contamination of the printer's service stations with an incompatible ink formulation or colors, electrical shorting of the pen or printer, physical damage to the pen or printer, or degredation of the printer performance.

While particular embodiments of the invention have been shown and described, it will be appreciated by those skilled in the art that various changes and modifications can be made without departing from the spirit and scope of the invention as set forth in the following claims.

We claim:

1. A method of preventing incorrect insertion of a pen cartridge into a wrong carriage compartment and incorrect insertion of a pen cartridge into a correct carriage compartment of a wrong printer, comprising the following steps:

providing a plurality of pen cartridges;

providing a plurality of printers, each printer having a respective carriage, each carriage having a respective plurality of compartments, each compartment being adapted for holding a respective one of said pen cartridges;

designating a plurality of pen cartridge option types, each option type being associated with a different one of said compartments of a same said carriage;

designating a plurality of printer family type, each family type being associated with a different one of said printers;

providing each of said pen cartridges with an option level lockout member corresponding to a respective one of said option types and a family level lockout member corresponding to a respective of said family types;

creating a respective key-coded first barrier within each carriage compartment of all said printers to provide an option level lockout against pen cartridges having a non-matching option level lockout member for such key-coded first barrier, to provide an option level lockout against pen cartridges having a respective key-coded option level lockout member interfering with the respective key-coded first barrier;

creating a second barrier within each carriage compartment of the printers intended for use with pen cartridges of a first family type, to provide a first family level lockout against pen cartridges of a second family type and having a respective first family level lockout member interfering with said second barrier; and creating a third barrier within each carriage compartment of the printers intended for use with said pen cartridges of a second family type, to provide a second family level lockout against pen cartridges of said first family type and having a respective family level lockout member interfering with said third barrier, wherein said first barrier and said second barrier are both located at an entrance of said carriage compartment, said second barrier is formed within said key-coded first barrier by a second level of key-coding, said third barrier is located in a floor of said carriage compartment remote from said entrance.

2. The method of claim 1 which further includes the step of positioning at least one keytab in different locations on said first family of pen cartridges to distinguish between said different option types.

3. The method of claims 2 which further includes the step Of positioning multiple keytabs in different locations on said second family of pen cartridges to distinguish between said different option types within said second family of pen cartridges, and to distinguish said second family from said first family.

4. The method of claim 3 which further includes the step of placing one wingtab in a first location on said first family of pen cartridges, in order to distinguish said first family from said second family.

5. The method of claim 4 which further includes the step of placing another wing tab in a second location on the second family of pen cartridges in order to distinguish the first and second families from a third family of pen cartridges.

6. The method of claim 4 which further includes the step of providing a universal family of pen cartridges having only said first level keytab and not having said wing tab.

7. Lockout apparatus for removable pen cartridges mounted in individual compartments of respective printer carriages, comprising:

a first family of pen cartridges including a first pen type having a predetermined number of horizontally projecting tab members;

a second family of pen cartridges including a second pen type having a downwardly projecting wing member not included on said first pen type, but not having all of said predetermined number of horizontally projecting tab members;

an entrance barrier in a vertical surface of selected said compartments and cooperating with said horizontally projecting tab members to provide a first lockout means preventing initial insertion of a pen cartridge of said first pen type but not interfering with complete insertion of a pen cartridge of said second pen type, and a second barrier in a horizontal surface of selected said compartments, said second barrier cooperating with said downwardly projecting wing member to provide a second lockout means preventing complete insertion of said second pen type but not interfering with complete insertion of a pen cartridge of said first pen type, thereby providing an ID scheme for selectively allowing either a first type or a second type of pen cartridge to be completely inserted into a respective said compartment.

8. The lockout apparatus of claim 7 wherein said entrance barrier includes one or more slots, and wherein said tab member is a key-coded tab member sized and spaced to match said slots.

9. The lockout apparatus of claim 8 wherein said second level lockout means includes at least two different barrier floor configurations at the bottom of the individual compartments.

10. The lockout apparatus of claim 8 wherein said key-coded tab member is displaced from a pen printhead on a surface perpendicular to the printhead.

11. The lockout apparatus of claim 8 wherein said wing member is on a surface the pen cartridges parallel to a pen printhead.

12. The lockout apparatus of claim 7, further comprising a third family of pen cartridges including a third pen type having more than said predetermined number of tab members, wherein said first and second pen types each include a second wing member not included on said third pen type, each said entrance barrier prevents insertion of pen cartridges having more than a respective first number of said horizontally projecting tabs, and each said second barrier prevents insertion of pen cartridges having more than a respective second number of said wing members.

* * * * *